US006491106B1

(12) United States Patent
Simonds

(10) Patent No.: US 6,491,106 B1
(45) Date of Patent: Dec. 10, 2002

(54) METHOD OF CONTROLLING A SUBSURFACE SAFETY VALVE

(75) Inventor: Floyd R. Simonds, Richardson, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/808,431

(22) Filed: Mar. 14, 2001

(51) Int. Cl.[7] ..... E21B 34/10; E21B 34/14; E21B 34/06

(52) U.S. Cl. ..... 166/375; 166/321; 166/332.1

(58) Field of Search ..... 166/321, 332.1, 166/332.8, 373, 374, 375; 91/508, 509

(56) References Cited

U.S. PATENT DOCUMENTS

| | | | | |
|---|---|---|---|---|
| 3,441,084 A | * | 4/1969 | Fredd | 166/189 |
| 3,786,867 A | | 1/1974 | Tausch et al. | |
| 4,026,355 A | * | 5/1977 | Johnson et al. | 166/246 |
| 4,161,219 A | | 7/1979 | Pringle | |
| 4,187,876 A | | 2/1980 | Lang | |
| 4,252,197 A | | 2/1981 | Pringle | |
| 4,495,998 A | | 1/1985 | Pringle | |
| 4,598,773 A | | 7/1986 | Pringle | |
| 4,621,695 A | | 11/1986 | Pringle | |
| 4,660,646 A | | 4/1987 | Blizzard | |
| 4,676,307 A | | 6/1987 | Pringle | |
| 5,167,284 A | * | 12/1992 | Leismer | 166/323 |
| 5,310,004 A | | 5/1994 | Leismer | |
| 5,343,955 A | | 9/1994 | Williams | |
| 6,179,052 B1 | | 1/2001 | Purkis et al. | |

FOREIGN PATENT DOCUMENTS

WO WO 00/04274 1/2000

OTHER PUBLICATIONS

Offshore Technology Conference Paper OTC 8198, "SCSSV System Design Considerations for Hardy Oil's Deepwater Projects," dated May, 1996.

Camco Advertisement, "Camco Deepwater Safety Systems", Describing a Job on Jun., 1997.

Camco Catalog Page, "TRC–DH Series Safety Values", Undated.

European Search Report for Application No. EP 02 25 1758.

* cited by examiner

*Primary Examiner*—David Bagnell
*Assistant Examiner*—Brian Halford
(74) *Attorney, Agent, or Firm*—William M. Imwalle; Marlin R. Smith

(57) ABSTRACT

A method is provided for controlling operation of a subsurface hydraulically operated well tool. In a described embodiment, a surface controlled subsurface safety valve is controlled utilizing two control lines. The control lines are hydraulically connected to respective ones of two pistons in the safety valve. Pressure applied to either of the two pistons is capable of independently operating the safety valve. In normal operation, pressure is applied to both of the pistons. However, when a failure occurs in one of the control lines, the other may still be used to operate the safety valve.

20 Claims, 3 Drawing Sheets

METHOD OF CONTROLLING A SUBSURFACE SAFETY VALVE

BACKGROUND

The present invention relates generally to operations performed in conjunction with a subterranean well and, in an embodiment described herein, more particularly provides a method of controlling a hydraulically actuated subsurface well tool.

Safety valves are being installed at progressively greater depths in wells. These increasing safety valve depths have created numerous problems for those responsible for the valve installations and operations.

One of these problems has to do with the need to run a control line to a safety valve installed at a very deep location in a well. An increase in the length of a control line brings with it the increased probability that a failure will be experienced in the control line at some point in the productive life of the well. This is due to, for example, an increased number of connections in the control line, an increased number of control line tubing sections, an increased probability of damage during installation, etc.

Various solutions have been proposed for dealing with this problem. Unfortunately, however, these prior solutions have required installation of an inordinate amount of additional equipment at the well, undue complexity and/or an increased probability of experiencing a failure requiring replacement of the safety valve, with the associated expense of killing the well, pulling the production string and installing a new production string.

What is needed is a method of controlling a hydraulically actuated subsurface well tool which does not require a large investment in additional equipment, which is relatively simple in construction and use, and which provides true redundancy for control lines installed in a well.

SUMMARY

In carrying out the principles of the present invention, in accordance with an embodiment thereof, a method is provided which solves the above problems in the art.

In one aspect of the present invention, a method of controlling a subsurface hydraulically actuated well tool is provided. The method includes the steps of hydraulically connecting a first control line to a first piston of the well tool and hydraulically connecting a second control line to a second piston of the well tool. The well tool is operable in response to pressure in the first control line, and the well tool is operable in response to pressure in the second control line. The well tool is operated by applying pressure to both of the first and second control lines, and then, in response to failure of the first control line, the well tool is operated by applying pressure only to the second control line.

In another aspect of the present invention, a single pump is used to operate the well tool when applying pressure to both of the first and second control lines. The same pump is then used when operating the well tool by applying pressure to only the second control line.

In yet another aspect of the present invention, a method of controlling a surface controlled subsurface safety valve is provided. The safety valve includes first and second pistons operatively connected to an opening mechanism of the safety valve. The first and second pistons are hydraulically isolated from each other in the safety valve.

The safety valve is operated by applying pressure to both of first and second control lines hydraulically connected to the first and second pistons, respectively. Then the safety valve is operated by applying pressure to only the second control line.

These and other features, advantages, benefits and objects of the present invention will become apparent to one of ordinary skill in the art upon careful consideration of the detailed description of a representative embodiment of the invention hereinbelow and the accompanying drawings.

DETAILED DESCRIPTION

In the following description, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

Figure 1:
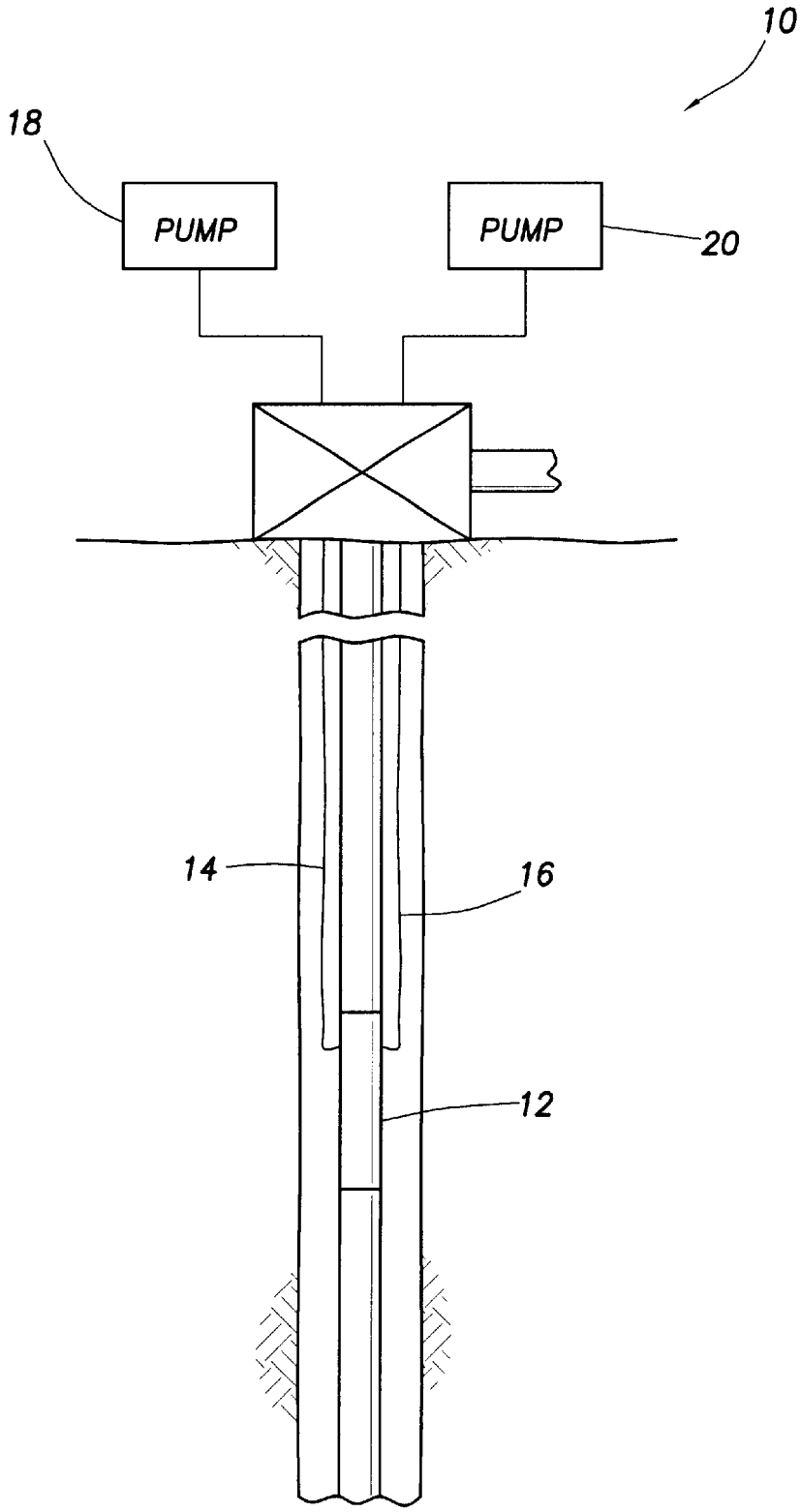
FIG. 1 (PRIOR ART)
FIG. 1 is a schematic cross-sectional view of a first prior art method of controlling a subsurface hydraulically actuated well tool.

Representatively illustrated in FIG. 1 is a prior art method 10 of controlling a subsurface safety valve 12. In the method 10, two control lines 14, 16 extend from the safety valve 12 to individual pumps 18, 20 situated at the surface. Thus, two complete hydraulic actuation systems are used, one including the control line 14 and pump 18, and the other including the control line 16 and the pump 20.

If a failure is experienced in one of the hydraulic actuation systems, the other hydraulic actuation system is used to control operation of the safety valve 12. Thus, the hydraulic actuation systems are used alternatively, i.e., only one of the hydraulic actuation systems is used at a time.

Note that one or more actuating pistons (not shown) of the safety valve 12 may be hydraulically connected to each of the control lines 14, 16, in which case a complex hydraulic switching system may be used in the safety valve to provide for the event of a failure in one of the control lines 14, 16.

Figure 2:
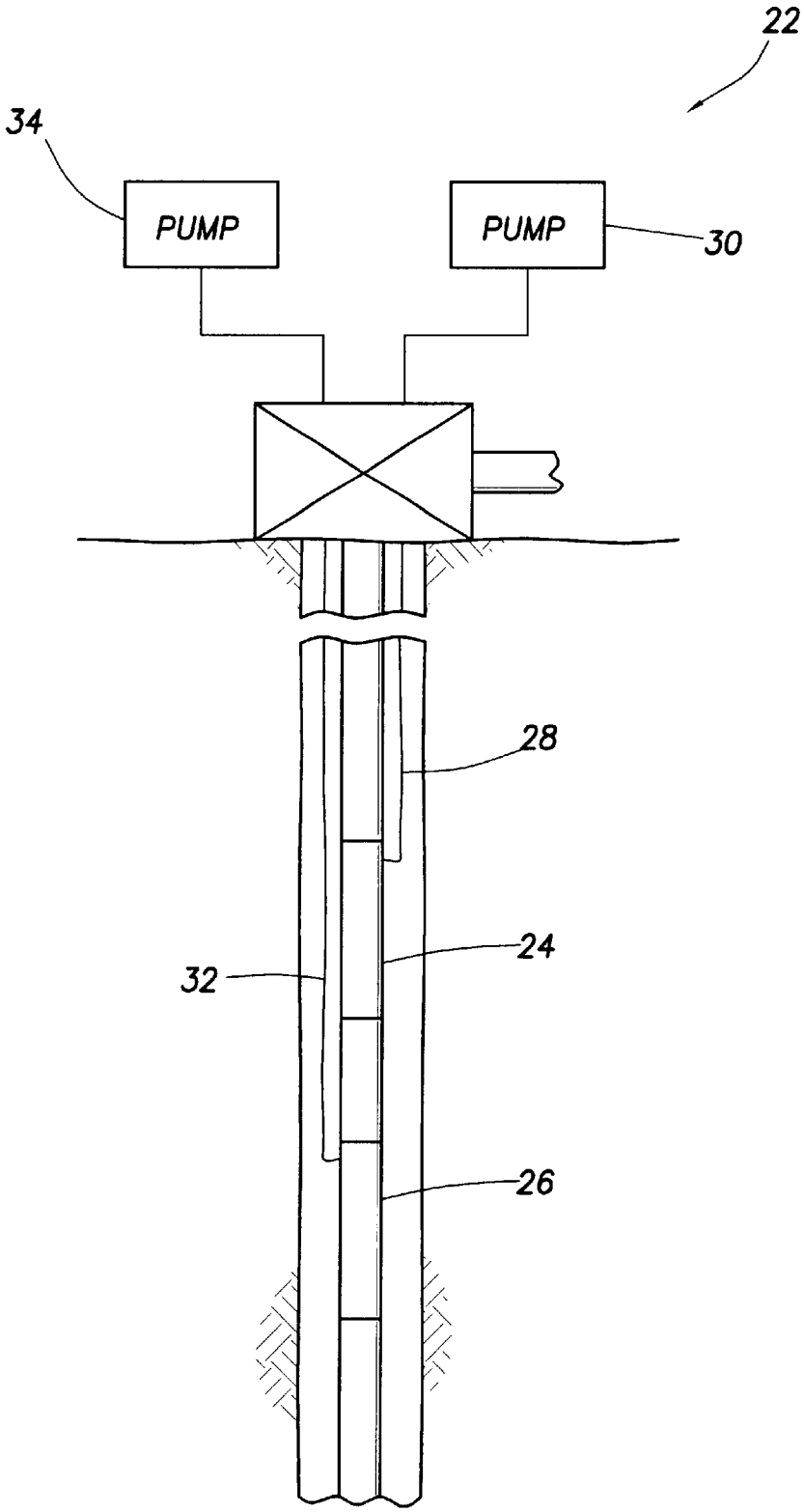
FIG.2 (PRIOR ART)
FIG. 2 is a schematic cross-sectional view of a second prior art method of controlling a subsurface hydraulically actuated well tool.

Representatively illustrated in FIG. 2 is another prior art method 22 of controlling multiple subsurface safety valves 24, 26. Redundancy is provided in this case by installing multiple complete safety valve systems. One safety valve system includes the safety valve 24, a control line 28 and a pump 30. The other safety valve system includes the safety valve 26, a control line 32 and a pump 34.

If a failure is experienced in one of the safety valve systems, the other safety valve system is used. While the method 22 does provide redundancy in the event of a control line failure, it does so at the expense of a large amount of additional equipment and added complexity.

For example, during production of the well one of the safety valves 24, 26 must be locked open while the other safety valve is being used, or it must be kept open using its associated pump and control line. In the former case, the locked open safety valve must be restored to an operating configuration (unlocked) if the other safety valve's control line fails, and the other safety valve must then be locked open. In the latter case, both complete safety valve systems must be operated, tested and maintained for the entire productive life of the well.

Figure 3:
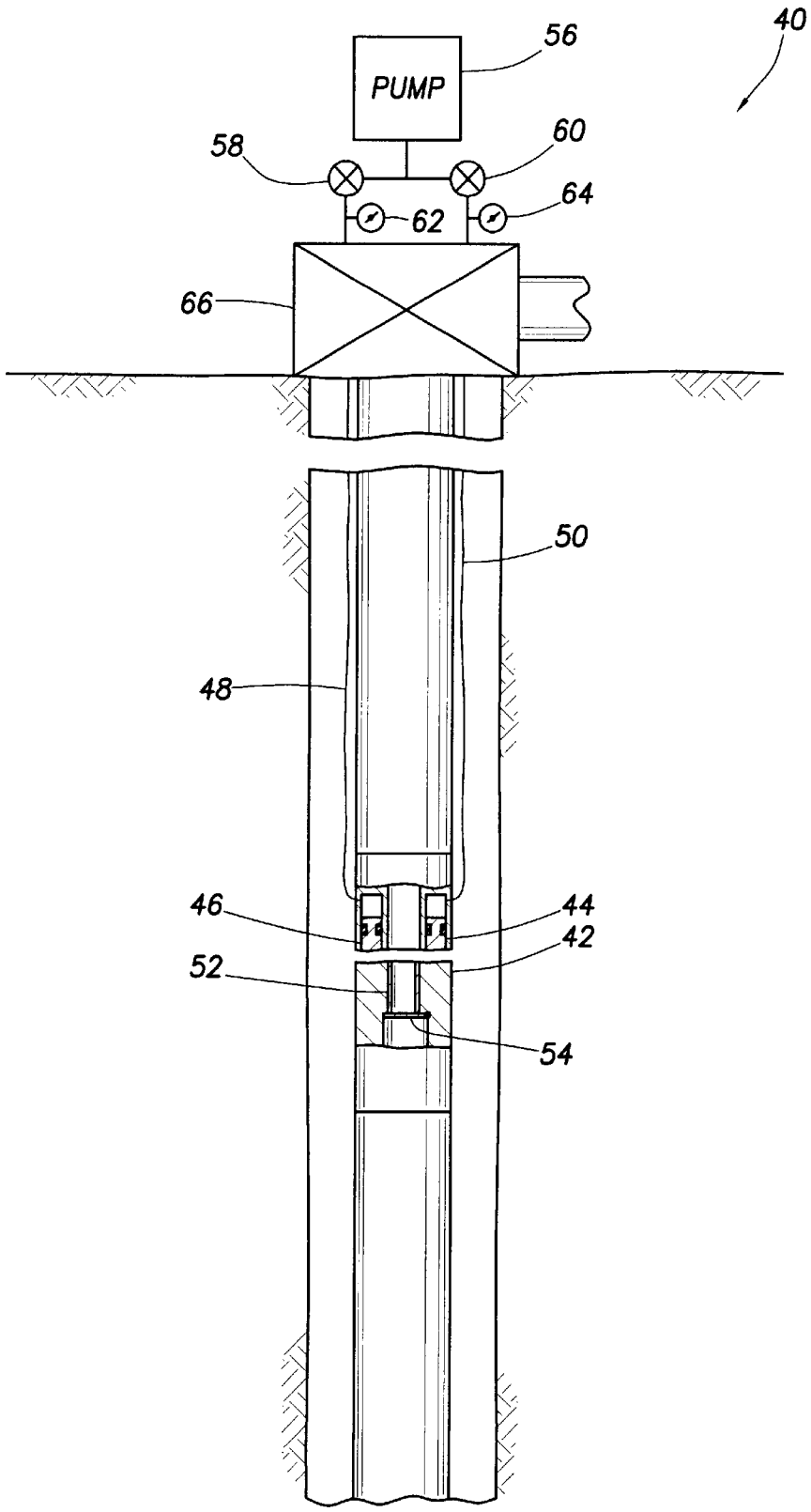
FIG. 3 is a schematic cross-sectional view of a subsurface hydraulically actuated well tool utilized in a tool control method embodying principles of the present invention.

Referring additionally now to FIG. 3, a method 40 of controlling operation of a subsurface safety valve 42 is representatively illustrated, the method embodying principles of the present invention. The method 40 does not require multiple pumps to be installed at the surface, does not require complex downhole hydraulic switching systems, and does not require multiple complete safety valve systems. Instead, the method 40 provides a cost effective, convenient and straight-forward means of ensuring that a control line failure will not require pulling the production string of a well.

The method 40 accomplishes these results by utilizing multiple actuating pistons 44, 46 in the safety valve 42. Each of the pistons 44, 46 is hydraulically connected to a respective one of multiple control lines 48, 50 extending to a remote location, such as the surface of the well.

Note that pressure applied to either of the pistons 44 or 46 via its respective control line 50 or 48 is capable of operating the safety valve 42, for example, by displacing an opening prong or flow tube 52 to actuate a flapper valve 54 of the safety valve 42. Persons skilled in the art are familiar with the use of a piston to actuate a flapper valve of a safety valve, and so no further description of this actuation will be presented herein. However, it is to be clearly understood that other types of safety valves, such as a safety valve having a ball valve instead of a flapper valve, may be used and other types of hydraulically actuated well tools may be used, without departing from the principles of the present invention.

In addition, note that the pistons 44, 46 are hydraulically isolated from each other in the safety valve 42. Thus, no hydraulic switching system must be used in the safety valve 42 in the event that a failure occurs in one of the control lines 48, 50.

In normal operation of the safety valve 42, pressure is applied to both of the control lines 48, 50 by a single pump 56. Multiple pumps are not required. Instead, a set of valves 58, 6o are used to select which of the control lines 48, 50 pressure is applied to from the pump 56. Since, in normal operation, pressure is applied to both of the control lines 48, 50, both of the valves 58, 60 are normally open.

If, however, a failure occurs in one of the control lines 48, 50, the corresponding valve 58 or 60 is closed, and the safety valve 42 is operated using pressure applied to the other control line. Thus, if a connector or one of the lengths of control line tubing in the control line 48 begins to leak, the valve 58 will be closed, and the safety valve 42 will be operated using pressure applied to the control line 50. Similarly, if a connector or one of the lengths of control line tubing in the control line 50 begins to leak, the valve 60 will be closed, and the safety valve 42 will be operated using pressure applied to the control line 48.

A failure of either of the control lines 48, 50 below a wellhead 66 of the well may be detected by monitoring pressure indicators 62, 64 readable at the surface above the wellhead and connected to the control lines, respectively, between the valves 58, 60 and the safety valve 42. The pressure indicators 62, 64 are depicted in FIG. 3 as pressure gauges, but other types of pressure indicators, such as pressure transducers, etc., may be used. A failure of the control line 48 would be evidenced by a drop in pressure indicated by the pressure gauge 62, in which case the valve 58 should be closed. A failure of the control line 50 would be evidenced by a drop in pressure indicated by the pressure gauge 64, in which case the valve 60 should be closed.

Note that, in the method 40, a failure of either of the control lines 48, 50 below the wellhead 66 may be remedied by observations made, and actions taken, above the wellhead. No change in the downhole safety valve 42 or control lines 48, 50 below the wellhead 66 need to be made.

It will be readily appreciated by one skilled in the art that, if pressure applied to only one of the pistons 44, 46 is used to operate the safety valve 42 due to failure of one of the control lines 48, 50, a greater pressure will typically be required to maintain the safety valve in an open position than if pressure were applied to both of the pistons. Thus, when pressure is applied to only one of the control lines 48, 50 to operate the safety valve 42, more pressure should be applied by the pump 56 to the control line. However, it will be recognized that this is far preferable to pulling the production string out of the well to repair the failed control line.

In most circumstances, a control line failure after initial installation and verification of pressure integrity is experienced only after a well has been in production for an extended period of time, for example, due to corrosion gradually deteriorating the control line tubing or connections. In these circumstances, wellbore hydrostatic pressure will likely have decreased due to the extended period of production of fluid from the well, and so a substantial increase in pressure applied to the remaining control line may not be required.

Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. Accordingly, the foregoing detailed description is to be clearly understood as being given by way of illustration and example only, the spirit and scope of the present invention being limited solely by the appended claims.

What is claimed is:

1. A method of controlling a subsurface hydraulically actuated well too, the method comprising the steps of:

hydraulically connecting a first control line to a first piston of the well tool, the well tool being operable in response to pressure in the first control line;

hydraulically connecting a second control line to a second piston of the well tool, the well tool being operable in response to pressure in the second control line;

operating the well tool by simultaneously applying pressure to both of the first and second control lines; and then, in response to failure of the first control line, operating the well tool by applying pressure only to the second control line.

2. The method according to claim 1, wherein a single pump is used in the step wherein pressure is applied to both of the first and second control lines.

3. The method according to claim 2, wherein the same pump is used in the step wherein pressure is applied only to the second control line.

4. The method according to claim 2, further comprising the step of hydraulically connecting the pump to the first control line via a first valve.

5. The method according to claim 4, further comprising the step of hydraulically connecting the pump to the second control line via a second valve.

6. The method according to claim 5, further comprising the steps of:

monitoring pressure in the first control line using a first pressure indicator connected to the first control line between the first valve and the first piston; and monitoring pressure in the second control line using a second pressure indicator connected to the second control line between the second valve and the second piston.

7. A method of controlling a subsurface hydraulically actuated well tool, the method comprising the steps of:

hydraulically connecting a first control line to a first piston of the well tool, the well tool being operable in response to pressure in the first control line;

hydraulically connecting a second control line to a second piston of the well tool, the well tool being operable in response to pressure in the second control line;

operating the well tool using a single pump simultaneously applying pressure to both of the first and second control lines; and then operating the well tool using the same pump applying pressure to only the second control line.

8. The method according to claim 7, further comprising the steps of:

hydraulically connecting the pump to the first control line via a first valve; and hydraulically connecting the pump to the second control line via a second valve.

9. The method according to claim 7, wherein the step of applying pressure only to the second control line is performed in response to a failure of the first control line.

10. A method of controlling a subsurface hydraulically actuated well tool, the method comprising the steps of:

providing the well tool as a surface controlled safety valve, the safety valve including first and second pistons operatively connected to an opening mechanism of the safety valve, and the first and second pistons being hydraulically isolated from each other in the safety valve;

operating the safety valve by simultaneously applying pressure to both of first and second control lines hydraulically connected to the first and second pistons, respectively; and then operating the safety valve by applying pressure to only the second control line.

11. The method according to claim 10, wherein the step of applying pressure only to the second control line is performed in response to failure of the first control line.

12. The method according to claim 10, wherein a single pump is used in the step wherein pressure is applied to both of the first and second control lines.

13. The method according to claim 12, wherein the same pump is used in the step wherein pressure is applied to only the second control line.

14. The method according to claim 12, further comprising the step of hydraulically connecting the pump to the first control line via a first valve.

15. The method according to claim 14, wherein the step of applying pressure only to the second control line is performed in response to failure of the first control line between the first valve and the first piston.

16. The method according to claim 14, further comprising the step of hydraulically connecting the pump to the second control line via a second valve.

17. The method according to claim 16, further comprising the steps of:

monitoring pressure in the first control line using a first pressure indicator connected to the first control line between the first valve and the first piston; and monitoring pressure in the second control line using a second pressure indicator connected to the second control line between the second valve and the second piston.

18. The method according to claim 17, wherein the step of applying pressure only to the second control line is performed in response to failure of the first control line detected by observing a drop in pressure indicated by the first pressure indicator.

19. The method according to claim 18, further comprising the step of closing the first valve prior to the step of applying pressure only to the second control line.

20. The method according to claim 19, wherein the step of applying pressure only to the second control line is performed in response to failure of the first control line below a wellhead, and the step of closing the first valve is performed with the first valve located above the wellhead.

* * * * *